United States Patent [19]

Fuhr

[11] 4,164,299

[45] Aug. 14, 1979

[54] TRAY FOR PAINT AND BRUSHES

[76] Inventor: Patti S. Fuhr, Rte. 2, Box 119C, Mantachie, Miss. 38855

[21] Appl. No.: 842,302

[22] Filed: Oct. 14, 1977

[51] Int. Cl.[2] ..... B44D 3/00; B65D 1/36; B65D 5/28

[52] U.S. Cl. ..... 220/20; 15/257.06; 220/90; 220/94 A; 224/48 R

[58] Field of Search ..... 220/20, 90, 94 R, 94 A; 206/1.7, 1.8, 1.9; 224/75 R, 48 R; 15/257.06

[56] References Cited

U.S. PATENT DOCUMENTS

| | | | |
|---|---|---|---|
| 748,052 | 12/1903 | Doggett | 220/94 R |
| 3,273,700 | 9/1966 | Moreau | 206/1.7 |
| 3,671,992 | 6/1972 | Linger | 206/1.7 |
| 3,760,996 | 9/1973 | Campbell | 224/48 R |
| 3,966,076 | 6/1976 | Kroger | 220/20 |
| 4,061,242 | 12/1977 | Donlon | 220/20 |

*Primary Examiner*—George E. Lowrance

[57] ABSTRACT

A hand held tray is disclosed having two open receptacles adjacent each other, one for paint the other for one or more brushes. An open space is provided between the receptacles to accommodate the fingers of the user as the tray is held and tabs are provided to be engaged by the thumb of the holding hand to steady the tray. The upper edge of the sidewalls of the first receptacle act as a stroking edge against which to draw the side of the brush to remove excess paint therefrom.

7 Claims, 4 Drawing Figures

FIG. 1
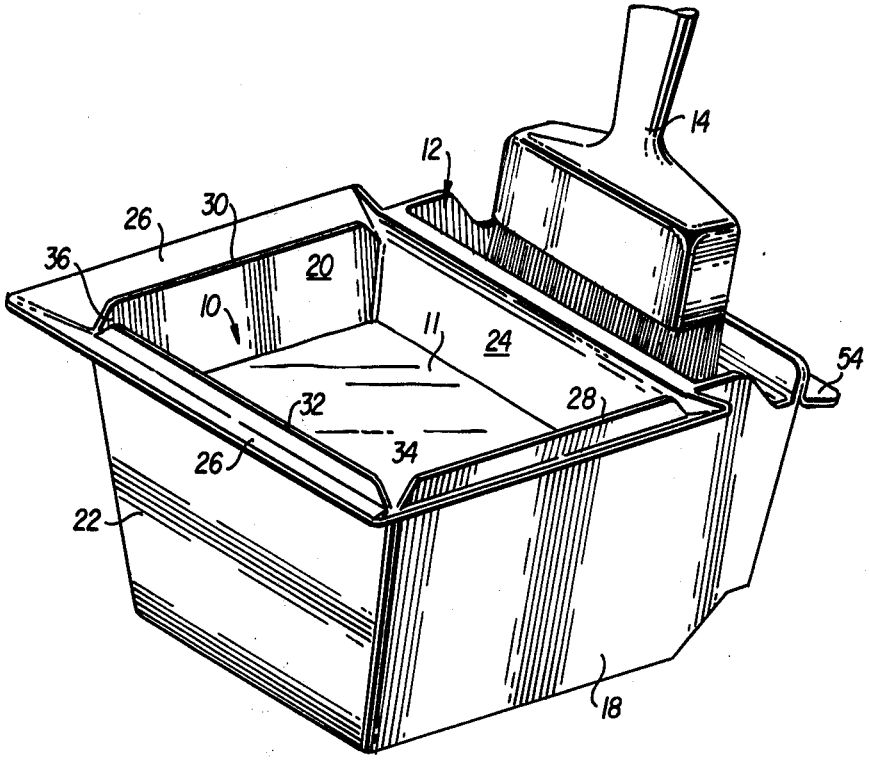
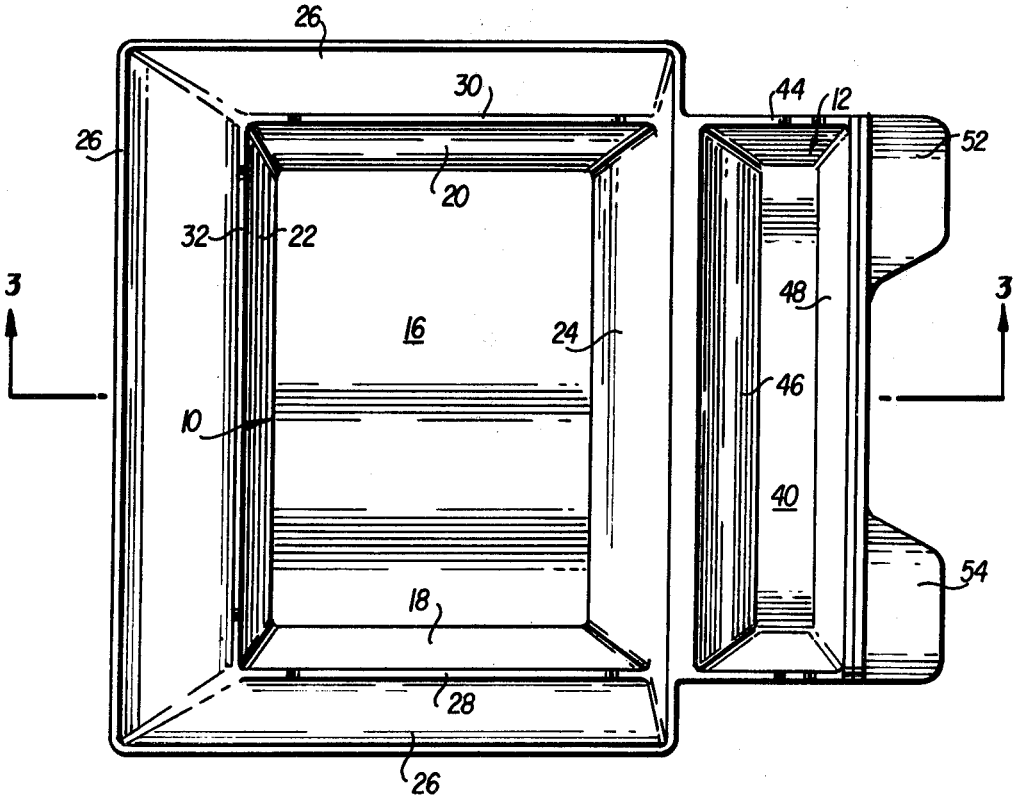
FIG. 2

TRAY FOR PAINT AND BRUSHES

BACKGROUND OF THE INVENTION

1. FIELD OF THE INVENTION

This invention relates to a painting aid and more particularly to a tray which can be held in either hand having open receptacles for both paint and brushes.

2. PRIOR ART AND OBJECTS

Applicants are unaware of any device which can be held in either hand of a painter and which has open receptacles for both paint and brushes as well as a stroking edge for removing excess paint from the brush. U.S. Pat. No. 3,688,943 discloses a device, for example, which can be attached to the rim of a paint can and has a single receptacle for holding brushes. Such devices may be satisfactory for use where the area to be painted is large and the entire can must be available for use or where a sufficiently large surface is available for supporting the entire can. Such devices are, however, unsatisfactory where a small quantity of paint and a small brush are more desirable and the available work space is limited such as when painting window frames, trim, moulding and the like. U.S. Pat. No. 3,776,371 discloses a receptacle for supporting artists brushes and a conditioner for such brushes but the device is not suitable to be held in the hand nor is a quantity of paint placed therein for subsequent use.

It is, therefore, the primary object of the present invention to provide a novel hand held receptacle for a quantity of paint and one or more brushes.

It is another object of the present invention to provide such a paint and brush receptacle having a plurality of lips with straight edges to uniformly remove from the brush excess paint as the brush is stroked against the lip.

It is still another object of the present invention to provide a receptacle for paint and brushes which can be comfortably and steadily held in either hand of the user.

It is yet another object of the present invention to provide a receptacle for paint and brushes which is easy to fill with paint and empty and clean after use.

It is a further object of the present invention to provide a receptacle for paint and brushes which is of compact, lightweight sturdy construction and relatively inexpensive to manufacture.

The novel features which are believed to be characteristic of the invention, both as to its organization and method of operation, together with further objectives and advantages thereof will be better understood from the following description considered in connection with the accompanying drawings in which a presently preferred embodiment of the invention is illustrated by way of example. It is to be expressly understood, however, that the drawing is for the purpose of illustration and description only and is not intended as a definition of the limits of the invention.

BRIEF DESCRIPTION OF THE DRAWINGS

FIG. 1 is a view in perspective of the tray for paint and brushes of the present invention;

FIG. 2 is a plan view of the tray of the present invention;

DETAILED DESCRIPTION OF THE PREFERRED EMBODIMENTS

Figure 3:
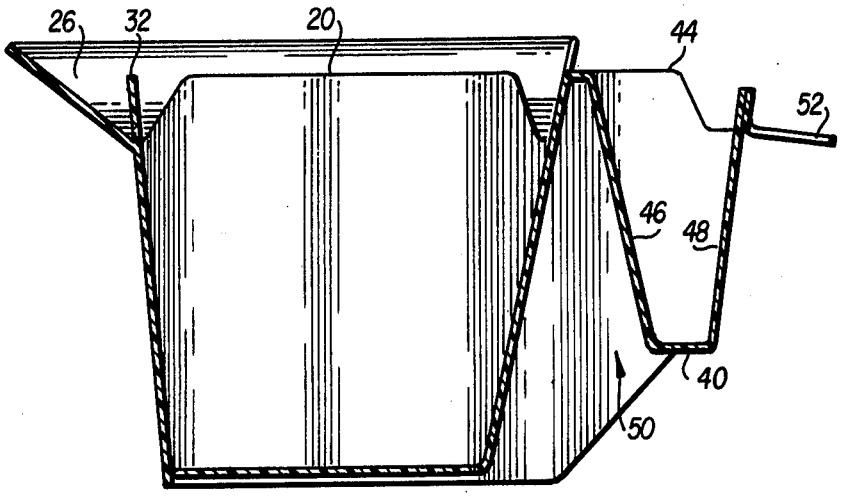
FIG. 3 is a cross-sectional view of the tray taken along the lines 3—3 of FIG. 2.
Figure 4:
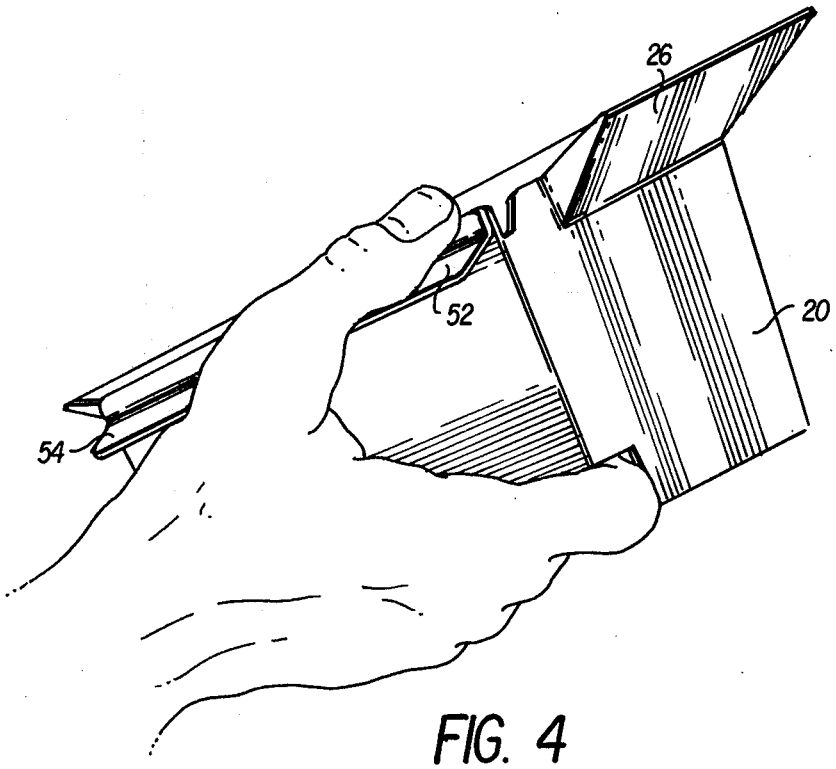
FIG. 4 is a view in perspective of the tray being held between the thumb and fingers of the right hand.

With reference now to FIGS. 1–4 of the accompanying drawings, the tray for paint and brushes is seen to comprise a first generally rectangular open receptacle designated 10 for storing a quantity of paint 11 and a second generally rectangular open receptacle designated 12 for storing one or more paint brushes 14.

The open receptacle 10 for paint includes a bottom wall 16 and a continuous upstanding side wall having sidewall portions 18, 20, a front wall portion 22 and a rear wall portion 24. The receptacle 10 also has an outwardly extending flange 26 which is continuous around side walls 18, 20 and front wall 22. As illustrated in the drawings, the wall portions 18, 20, 22 and 24 of the receptacle 10 are outwardly inclined at a slight angle with respect to the bottom wall 16 and the outwardly extending flange 26 is also inclined at a slight angle with respect to the walls 18, 20 and 22. The flange 26 is located a distance from the upper edge 28 of side wall portion 18, upper edge 30 of side wall portion 20 and upper edge 32 of front wall portion 22. The upper edges 28, 30 and 32 are not joined in the area above the flange 26 and in fact are separated at their ends by a gap 34 between upper edges 28 and 32 and by a gap 36 between upper edges 30 and 32. The upper edges 28 are straight-edge plates against which the side of a paint brush may be drawn or stroked as the brush is withdrawn from the open receptacle 10 after being dipped into the paint therein. The straight edge plate 28 provides assurance that the excess paint in the brush (i.e. that amount of paint which is desired to be removed before applying the brush to the surface to be painted) is removed uniformly from the brush. The gaps 34, 36 provide a return path to the receptacle 10 for the paint which is removed during stroking and deposited adjacent the outer surface 38 of the upper edges 28, 30, 32.

The open receptacle 12 for brushes is located adjacent the open receptacle 10 for paint and it includes a bottom wall 40, side wall portions 42, 44, rear wall portion 46 and a front wall portion 48. As illustrated in the drawings, the wall portions 42, 44, 46 and 48 of open receptacle 12 are also outwardly inclined at a slight angle with respect to the bottom wall 40. The rear wall 24 of receptacle 10 forms a compartment 50 with rear wall 46 of receptacle 12 for inserting the fingers of either hand to hold the tray as shown best in FIG. 4.

Thus tabs 52, 54 extend away from the front wall 48 in spaced apart relationship to each other. The tabs 52, 54 are positioned on the front wall 48 so that the tab 52 would be engaged by the holder's thumb to steady the tray when the tray is being held in the right hand and tab 54 is engaged when the tray is being held in the left hand. As the bottom of the user's thumb engages one tab, the top of the user's thumb will engage the bottom of the other tab which arrangement when combined with the gripping of the fingers and hand against the front and rear side wall portions of receptacle 12 virtually eliminates any possibility of the tray being dropped even if it is severely bumped. The flat outer surface of bottom wall 16 enables the tray to rest on other flat surfaces without danger of tipping and spilling.

In operation, paint or other liquid to be spread is poured into open receptacle 10 to the desired level and brushe(s) are placed in open receptacle 12. The tray is held as shown and previously described and the brush is dipped into the paint and stroked against one of the three upper edges 28, 30, 32 which is most convenient. The excess paint removed from the brush returns to the open receptacle 10. When returning to refill receptacle 10, the brush can be inserted in receptacle 12. When painting is completed, the remaining paint in receptacle 10 can be poured back into the can through gaps 34 or 36. Receptacles 10 and 12 can then be cleaned with turpentine or the like and the tray is ready for reuse.

The foregoing is considered as illustrative only of the principles of the invention. Further, since numerous modifications and changes will readily occur to those skilled in the art, it is not desired to limit the invention to the exact construction and description, and accordingly all suitable modifications and equivalents may be resorted to falling within the scope of the invention.

I claim:

1. A hand held tray for paint and brushes comprising:

(a) a first open receptacle having a bottom wall, a front wall and a rear wall each having an upper and lower edge, said lower edge being secured to said bottom wall to form said first open receptacle for holding a quantity of paint, (b) a second open receptacle having a bottom wall, a front wall and a rear wall located adjacent said first open receptacle for holding at least one paint brush, said rear wall of said second receptacle being opposite to and spaced apart from said rear wall of said first open receptacle to form a recess for the fingers of the user's hand, and (c) two outwardly extending, spaced apart tab means adjacent the upper edge of the front wall of said second open receptacle, one of said tab means serving to be engaged by the bottom end portion of the thumb and said other tab means serving to be engaged by the top portion of the thumb of said hands of said user to enable said tray to be held firmly by said user by engaging said tabs between said top and bottom portions of said thumb and said fingers of said hand engaging said recess.

2. A tray as set forth in claim 1 further comprising a continuous flange extending outwardly from said side wall of said first open receptacle, said flange being spaced a distance from said upper edge of said side wall.

3. A tray as set forth in claim 2 wherein said upper edge of said side wall of said first open receptacle provides a stroking edge against which to draw the side of said brush to remove excess paint therefrom, said upper edge being discontinuous to permit said excess paint to drain back into said first open receptacle.

4. A tray as set forth in claim 1 wherein two separate single pieces of material form a part of the side wall of both said first and second open receptacles.

5. A tray as set forth in claim 4 wherein said material is plastic.

6. A hand held tray for paint and brushes comprising:

(a) a first open receptacle having a bottom wall and an upstanding side wall having an upper and lower edge, said lower edge being secured to said bottom wall to form said first open receptacle for holding a quantity of paint, (b) a second open receptacle having a bottom wall and an upstanding side wall located adjacent said first open receptacle for holding at least one paint brush, one of said side walls of said second receptacle being opposite to and spaced apart from one of said side walls of said first open receptacle to form a recess to enable the fingers of the user's hand to hold said tray, said upper edge providing a stroking edge against which to draw the side of said brush to remove excess paint therefrom, and (c) a continuous flange extending outwardly from said side wall of said first open receptacle, said flange being spaced from said upper edge of said side wall to receive said excess paint.

7. A tray as set forth in claim 6 wherein said upper edge is discontinuous to permit said excess paint to drain back into said first open receptacle.

* * * * *